United States Patent [19]

Thompson et al.

[11] 3,942,958

[45] Mar. 9, 1976

[54] COMPOSITION CONTROL OF GASES

[75] Inventors: Brian Hoyle Thompson, London; Henry Lawrence Conway, Solihull, both of England

[73] Assignee: British Gas Corporation, London, England

[22] Filed: July 31, 1974

[21] Appl. No.: 493,485

[30] Foreign Application Priority Data

Aug. 3, 1973 United Kingdom ..... 36901/73

[52] U.S. Cl. ..... 48/213; 48/197 R; 23/284; 23/285; 260/449 M

[51] Int. Cl.[2] ..... C01B 2/22

[58] Field of Search ..... 48/214, 215, 197 R, 213; 260/449 M

[56] References Cited

UNITED STATES PATENTS

| | | | |
|---|---|---|---|
| 2,707,147 | 4/1955 | Shapleigh | 48/214 X |
| 2,980,523 | 4/1961 | Dille et al. | 48/215 |
| 3,010,813 | 11/1961 | Clarke et al. | 48/215 |
| 3,022,148 | 2/1962 | James | 48/215 |
| 3,414,247 | 12/1968 | Sama | 48/214 UX |
| 3,620,697 | 11/1971 | Wunderlich et al. | 48/99 |
| 3,660,046 | 5/1972 | Smith | 48/215 |

*Primary Examiner*—R. E. Serwin
*Attorney, Agent, or Firm*—Larson, Taylor and Hinds

[57] ABSTRACT

Gases which are produced by the hydrogenolysis of hydrocarbons and which contain hydrogen, paraffins and aromatic compounds are contacted with a quenching medium such as a cooled fluidised bed or a cooled inert gas or liquid to cool the gas to a temperature lower than that which will support any substantial reaction between the hydrogen, paraffinic and aromatic constituents to produce carbonaceous compounds which will be deposited on the surfaces of reaction vessel or gas off-takes. Methane containing gases produced by the non-catalytic hydrogenolysis of oils with a hydrogenating gas at temperatures between 500°–1000°C may be quenched to a temperature not greater than 700°C to prevent after reaction.

13 Claims, 2 Drawing Figures

COMPOSITION CONTROL OF GASES

This invention relates to the control of the composition of gases produced by the hydrogenolysis of carbonaceous fuels.

Fuel gases, having a high methane content, may be produced by the reaction at elevated temperature and pressure of hydrogen with hydrocarbons present in liquid or solid fuels. Depending upon the techniques employed, the hydrogenation may be carried out in the presence or absence of a suitable catalyst. Where no catalyst is employed it is desirable that the hydrocarbon and hydrogen containing gases contact each other for a period of time sufficient for the desired degree of hydrogenation to take place under controlled temperature conditions. One such method for example, as described in our UK Patent Specification No. 830,960 and 1,154,321 employs a fluidised bed of suitable particulate solids to control this temperature. The product gases drawn off comprise hydrogen, methane, higher paraffins and aromatic compounds of which a proportion may be polycyclic compounds. The product gases may also comprise steam. The temperature of the reactor bed is regulated in order to control the composition of the off-gas.

In another method for producing methane containing gases by the vapour phase hydrogenation of a hydrocarbon distillate oil comprising aliphatic constituents, wherein the oil vapour and a gas comprising hydrogen are continuously introduced into a thermally insulated reaction chamber so constructed as to define an endless path along which gas can circulate within the chamber, the oil vapour is reacted exothermically with hydrogen in the chamber at a temperature within the range of from 600° to 800°C, under a pressure of at least 5 atmospheres, gauge, gaseous products of reaction are continuously withdrawn from the reaction chamber, the reactants are introduced in the form of at least one jet through orifice means into the reaction chamber to cause a substantial body of gas comprising both reactants and reaction products to circulate continuously around the said endless path, and the reactants are preheated to an extent such as to maintain a reaction temperature within the aforesaid range that is substantially uniform throughout the interior of the reaction chamber except in the vicinity of the orifice means.

The methods disclosed in our aforementioned Patent Specifications may be adapted for the production of ethylene as disclosed in our UK Patent Specification Nos. 1,265,415 and 1,333,776.

However, in the off-takes from the reactor, for example in the space above a fluidised bed provided to allow for particles entrained in the gases leaving the bed to lose momentum and fall back onto it, usually called the disengagement space, temperature control is more difficult to achieve than in the bed itself. There is a tendency in the off-take or disengagement space for the polycyclic aromatic compounds already present to undergo further polymerisation to form compounds which approach carbon more closely in composition and appearance, and for fresh polycyclic compounds to form from simpler aromatics. After reaction may also occur in the off-take between hydrogen and paraffins or alkylated aromatic hydrocarbons which, being exothermic leads to a rise in temperature. This accelerates reactions, including polymerisation and aggravates the formation of the more carbonaceous materials.

These high molecular weight carbonaceous compounds tend to deposit on the surface of the exit ports and subsequent heat exchange equipment and this, in time causes blockages leading to severe disturbance and restriction of gas flow from the hydrogenation reactor as well as reducing the effectiveness of any heat exchange equipment. Several attempts have been made to solve this problem of deposition, including streamlining the reactor off-takes. These attempts, in general have not been successful.

The present invention provides a process for controlling the composition of gases produced by the hydrogenation of carbonaceous fuels which process comprises contacting said gas with a quenching medium to cool the gas to a temperature lower than that which will support substantial reactions involving any of the components comprising hydrogen, paraffinic hydrocarbons and aromatic hydrocarbons, present in the gas.

The purpose of the quenching action is to control the temperature of the effluent gas to such an extent that reactions which lead to the formation of deposits on the surfaces of the exit ports of the reactor are minimised or eliminated. In the extreme the quenching may be such that high molecular weight aromatic fractions of the gas are condensed to liquids and thus removed from the effluent gas streams.

The temperature of for example, a fluidised bed reactor in which gas production takes place lies between 500° and 1000°C when it is typically within the range 725° to 775° e.g. 750°C., in order to minimise any temperature rise due to after reaction in the disengagement section, the temperature in that section should be no higher than the temperature within the reactor, and preferably lower than the reactor temperature. We have found that after reaction in the disengagement space can be substantially reduced if the temperature in as much of the space as possible is controlled below 700°C.

According to one aspect of the invention quenching may be effected by directly spraying the quenching medium into the hydrogenator product gas. This may be effected by rapidly and thoroughly admixing a cooling gas with the product gas for example by causing the gas mixture to circulate along an endless path, to achieve the uniform desired degree of cooling. This ensures good even mixing and close temperature control. Solids or liquids may also be employed as coolant. Preferably the solids are entrained in a cooling gas and the suspension of solids in the gas is mixed with the reactor gases.

In accordance with a further aspect of the invention, the temperature of the product gases may be reduced and controlled by contacting them with a cooled fluidised bed located above the main hydrogenation reaction zone, e.g. the fluidised bed, in which the hydrogenation reactions occur and separated from said zone for example by means of one or more perforated plates. The bed may be cooled either indirectly by cooling coils, or directly, by contacting it with a quenching stream of a suitable gas or liquid; these methods may, if desired, be used together.

In yet another aspect of the invention quenching is effected by isolating the product gases from the surfaces of the plant by interposing a stream of inert gas between said surfaces and the product gas and quenching the product gas stream with a liquid containing a large proportion of monocyclic aromatic compounds, down to a temperature sufficiently low to condense the higher molecular weight components of the product gas stream. Thus condensed components dissolve in the aromatic condensate derived from the quenching gas and are carried out as mist or droplets.

Embodiments of the invention are described in greater detail with reference to the accompanying drawings which are diagrammatic vertical sections of off-take portions of a fluidised bed hydrogenator.

Figure 1:
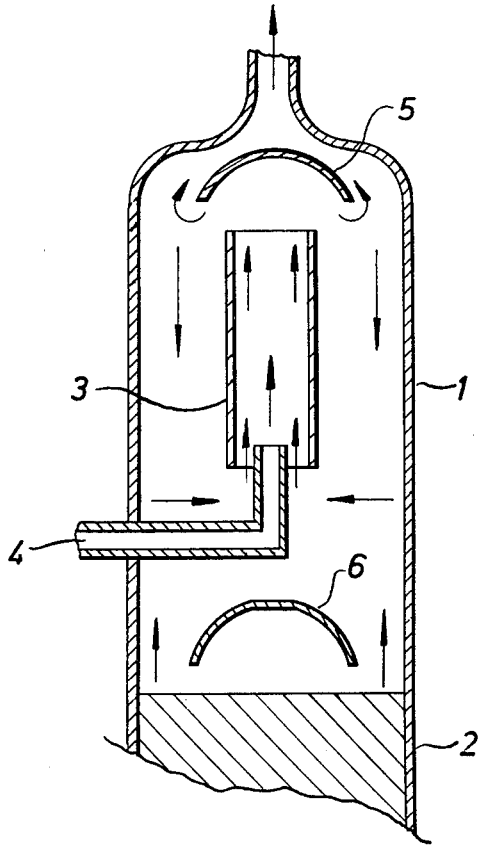
FIG. 1 is a sectional view of one preferred embodiment of the present invention for the quenching of off-gases from a fluidized bed hydrogenator.

In one embodiment of the invention, the main reaction zone which may be for example, a fluidised bed a second zone is provided in which the effluent gas is caused to circulate. Circulation is brought about by injection of a cool quenching gas into the second zone, so as to entrain the effluent gas. Circulation of the gas, prior to transmission to later stages of the gas production plant, prevents hot-spots occuring due to after reaction and generally allows uniform cooling of the gas to any desired temperature. As shown in FIG. 1 a zone is provided above a conventional fluidised bed hydrogenator 2. Off-gases from the fluidised bed are entrained through tube 3 by, and mix with, a quenching gas which is being injected into the tube through feed pipe 4. More than one zone 1 can be used if desired by providing a plurality of tubes 3 each associated with at least one injector feed pipe 4. The momentum of the quench gas injected into the system is used to induce the recirculation. The quenching gas may be steam, carbon dioxide, a benzene-rich liquid (hereinafter referred to as "benzole") obtained from the hydrogenator products or re-cycled rich gas, which is preferably free of polycyclic aromatic compounds. Since the velocity of the gases in the recycle tube 3 is likely to be high a baffle 5 may be provided to reduce the entrainment of solids which would pass out with the quenched effluent gas. In order to keep the velocity of the circulating gas in this zone relatively low the diameter of the zone may be greater than that of the main reaction zone. This reduces the tendency for particles from the fluidised bed to be entrained. A cyclone (not shown) may be provided in the quenched effluent gas outlet to remove entrained solids. In alternative arrangements the quenching gas inlet may be positioned in the side wall of the zone or even in the fluidised section. More than one such inlet may be provided to maintain adequate recirculation. A baffle 6 may be placed between zone 1 and 2 to prevent undue quantities of solid material, e.g. particles of the fluidised bed, from entering the quenching zone.

In a second embodiment the off-gases from the hydrogenation zone may pass through a fluidised bed located by and supported upon one more perforated plates, the holes in which need not be of the same size or in register. The bed may be cooled by immersing cooling coils in it. Alternatively the bed may be cooled by directly injecting therein a quenching gas e.g. recycled rich gas stream or carbon dioxide or a quench liquid such as water or benzole. If desired, further plates, termed baffle plates may be immersed in the bed. The baffle plates may be employed to improve fluidisation quality in and minimise entrainment from said fluidised bed. Additionally or alternatively the baffles may be employed to promote solids circulation in the bed. In those cases where cooling coils are immersed in the bed, they may be positioned to act as baffles for any of the foregoing purposes. Solids circulation may also be encouraged by the design of the perforated plate or plates.

In a third embodiment of the invention cool solid particulate material is sprayed into the effluent gases leaving the hydrogenation zone. The solids spray may be injected into the effluent contained in a suitably sized quenching chamber in a direction either concurrent or countercurrent to the effluent flow, or tangentially into the gas. In those cases where the hydrogenation zone is a fluidised bed reactor, the solids materials may be picked up from the fluidised bed reactor by a cool gas stream or alternatively the solids employed for the quenching may be conveniently employed as fresh make-up material for the fluidised bed once they have served their purpose as a quenching agent.

Figure 2:
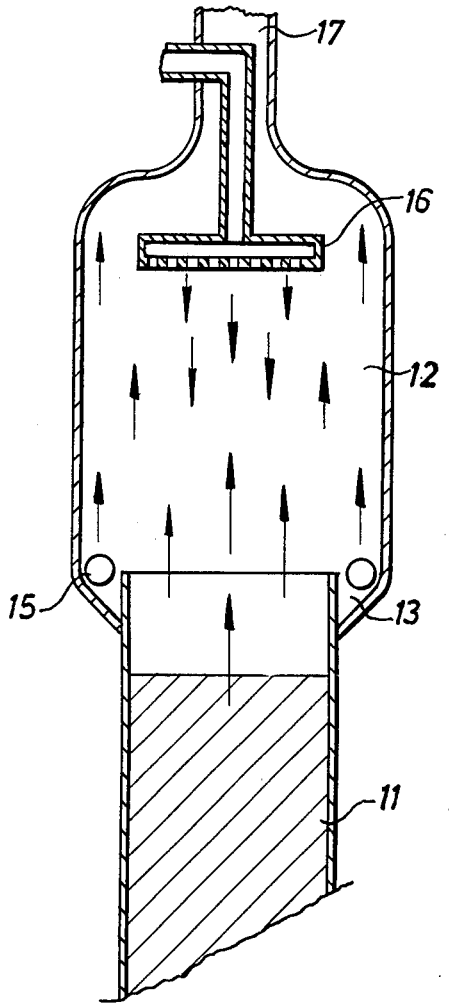
FIG. 2 is a sectional view of another embodiment of the invention.

FIG. 2 schematically illustrates a fourth embodiment of the invention. Effluent gas leaves the hydrogenation reactor chamber 11 and passes into the quenching chamber 12. The quenching chamber 12 may have a larger cross section than that of the hydrogenator 11. An annular space is defined by the wall of chamber 12 and a vertical baffle 13 which may be an extension of the wall of chamber 11. Within the annular space a ring main 15 is positioned provided with ports opening into chamber 12 for passing a gas stream free from polycylic aromatics, e.g. recycled rich gas or steam into the quenching chamber. The gas stream acts as a barrier between the wall or chamber 12 and the gas flow from the hydrogenator. A cooling fluid, e.g. benzole with or without water is sprayed into the hydrogenator effluent gas from a head 16 positioned in the centre of the gas off-take 17. The fluid spray cools the product gas from the fluidised bed to a temperature which may be below that of the dew point of benzole so that any condensation formed on the gas off-take surfaces is in the form of a liquid rich in benzole. The portion of gas leaving the main reaction zone which contains higher polycyclic compounds is cooled away from the surfaces of the vessel and therefore deposition of solids on vessel surfaces is prevented due to the barrier formed by the gas which is free from polycylic aromatics.

Although the invention is applicable with respect to the temperature control of off gases from a fluidised bed hydrogenator or gas recycle hydrogenator it may also be applied in other circumstances where temperature control is necessary. The process of the invention may also for example, be employed for further cooling of the hydrogenator products in separate vessels. Thus a plurality of quenching stages may be provided to control the temperature of reactor off gases.

The process may be advantageously employed in the production of fuel gases containing major proportions of methane or methane and ethane. Product gases containing ethane in substantial proportions may be employed for the production of ethylene.

The present invention therefore provides a process for the production of methane containing gases wherein the vapour hydrocarbon fuel is subjected to hydrogenolysis in the presence of a hydrogen containing gas at a temperature of from 500° to 1000°C and said hydrogenolysis product gas is cooled to a temperature which is not greater than 700° by a process as hereinbefore described in accordance with the invention.

The present invention also provides a process for the production of ethane and methane containing gas wherein the vapour of a hydrocarbon fuel is subjected to hydrogenolysis in the presence of a hydrogen-containing gas at a temperature of from 650° to 750°C and said hydrogenolysis product gas is cooled to a temperature not greater than 700°C by a process as hereinbefore described in accordance with the invention.

The hydrogenolysis may be effected either by causing the reactants to circulate around an endless path or within a circulating fluidised bed of inert solid particles.

The invention also provides apparatus in the manner described for carrying out the process of the invention and a hydrogenator including said apparatus.

The invention will now be illustrated by reference to the following Examples:

EXAMPLE 1

A crude oil of SG 0.82 was introduced at a rate of 5850 lb/hr into a bed of finely crushed coke particles which was fluidised by 145,820 lbs standard cubic feet/hr a gas of the composition A.

| | A | B |
|---|---|---|
| $H_2$ | 81.0% | 30.6% |
| CO | 2.3% | 2.0% |
| $CH_4$ | 15.2% | 49.7% |
| $C_2H_6$ | 1.0% | 17.0% |
| $CO_2$ | 0.5% | 0.7% |

After removal of ungasified material a product gas of the composition B was obtained. The fluidised bed temperature was maintained at 750°C whilst in the disengagement space there was a temperature rise to 770°C due to 'after reaction'. The operating pressure was 780 psig.

This experiment was repeated using the same crude oil and hydrogenating gas rates. In this second experiment approximately 53,000 scf/hr of gas A at 130°C was introduced just above the fluidised bed surface. The quench gas rate was sufficient to maintain the disengagement space temperature at 700°C. The introduction of quench gas reduced the concentration of polynuclear aromatic compounds in the disengagement space from 1.12% (vol) to 0.76%. By weighing the carbon deposited in the reactor gas offtake piping it was determined that by quenching the disengagement space to 700°C the rate of carbon deposition was reduced by a factor of 22.

EXAMPLE 2

A crude oil of SG 0.85 was introduced into a bed of finely crushed coke particles which was fluidised by 5400 scf/hr of a gas of the composition C.

| | C | D |
|---|---|---|
| $H_2$ | 93.8% | 56.5% |
| CO | 1.2% | 0.7% |
| $CH_4$ | 4.4% | 30.4% |
| $C_2H_6$ | — | 12.0% |
| $CO_2$ | 0.6% | 0.4% |

After removal of ungasified material a product gas of the composition D was obtained. The fluidised bed temperature was maintained at 750°C and the operating pressure 750 psig. The operation was carried out in two parts. In the first part of the operation the disengagement space temperature was controlled 675°C by spraying 15 lb/hr of water of 165°C through a nozzle just above the fluidised bed surface. Under this condition the concentration of polynuclear aromatic material in the disengagement space was 0.77%. In the second part of the operation the disengagement space temperature was controlled at 600°C by increasing the quench water rate to 45 lbs/hr. In this case the concentration of polynuclear aromatics in the disengagement space was reduced to 0.67% by the increased partial pressure of water vapour. The rate of deposition of carbon material was inferred from continuous measurement of the pressure loss across the gas offtake pipe section, from which it was determined that at the disengagement space temperature of 600°C the rate of carbon deposition was 16 times less than at the disengagement space temperature of 675°C.

We claim:

1. A process for controlling the composition of gases produced by the hydrogenolysis of carbonaceous fuels which process comprises contacting said gas in a vessel with a quenching medium to cool the gas to a temperature lower than that which will support substantial reactions involving any of the components hydrogen, paraffinic hydrocarbons or aromatic hydrocarbons, present in the gas, wherein said quenching is achieved by interposing a stream of insert gas between said gas and the walls of the vessel containing said gas, and admixing a cooling fluid containing a major proportion of monocyclic aromatic compounds with said gas to cool it to temperature at which any higher molecular weight constituents which would be deposited on surfaces are dissolved in said cooling fluid.

2. A process as claimed in claim 1 wherein said gas in said vessel is a methane containing gas.

3. A process as claimed in claim 1 wherein said gas in said vessel is rich in ethane.

4. A process as claimed in claim 1 wherein said inert gas is cooled product, said gas in said vessel is selected from the group consisting of a hydrogenating gas for use in the hydrogenolysis of carbonaceous fuels, carbon dioxide and steam.

5. A process as claimed in claim 1 wherein said cooling fluid comprises a benzene-rich liquid.

6. A process as claimed in claim 5 wherein said cooling fluid comprises benzole.

7. A process as claimed in claim 5 wherein said cooling fluid comprises a benzole-water mixture.

8. In a process for the production of methane by the vapor phase non-catalytic hydrogenolysis of a hydrocarbon feedstock wherein (i) the vapor of a normally liquid hydrocarbon feedstock is reacted with a hydrogen containing gas at a temperature of from 500° to 1000°C to produce a gas comprising a major proportion of methane and minor proportions of other paraffins, hydrogen carbon oxides and aromatic compounds, the improvement comprising (ii) interposing a stream of an inert gas between said methane containing gas and the walls of a vessel containing said methane containing gas, and (iii) contacting the methane containing gas with a benzene cooling fluid to cool the methane containing gas after substantial completion of the hydrogenolysis reaction to a temperature of not greater than 700°C and which is lower than that which will support substantial reaction involving any of the components selected from the group consisting of hydrogen, paraffinic hydrocarbons and aromatic hydrocarbons which are present in said methane containing gas.

9. A process as claimed in claim 8 wherein said hydrogenolysis step (i) is effected by causing said feedstock and said hydrogen-containing gas to circulate in admixture along an endless path.

10. A process as claimed in claim 8 wherein said hydrogenolysis step (i) is effected within a circulating bed of fluidised solid particles which are inert with respect to the hydrogenolysis reactions.

11. In a process for the production of ethane rich gases by the non-catalytic hydrogenolysis of a hydrocarbon feedstock in the vapor phase wherein the vapor of a normally liquid hydrocarbon feedstock is reacted with a hydrogen containing gas at a temperature of from 650° to 750°C to produce a gas comprising a major proportion of methane and minor proportions of other paraffins, hydrogen, carbon oxides and aromatic compounds, the improvement comprising contacting the ethane containing gas with a quenching medium selected from the group consisting of a fluidised bed of solid particulate material, steam, water, carbon dioxide, a benzene-rich liquid, previously produced methane or ethane containing gas and a hydrogen containing gas to cool the methane containing gas after substantial completion of the hydrogenolysis reaction to a temperature of not greater than 700°C and which is lower than that which will support substantial reactions involving any of the components selected from the group consisting of hydrogen, paraffinic hydrocarbons and aromatic hydrocarbons which are present in said ethane containing gas.

12. A process as claimed in claim 11 wherein said hydrogenolysis step is effected by causing said feedstock and said hydrogen-containing gas, in admixture, to circulate along an endless path.

13. A process as claimed in claim 11 wherein said hydrogenolysis reaction is effected within a circulating bed of fluidised solid particles which are inert with respect to the hydrogenolysis reactions.

* * * * *